US010221591B2

(12) United States Patent
Lai

(10) Patent No.: US 10,221,591 B2
(45) **Date of Patent: *Mar. 5, 2019**

(54) PADLOCK WITH FULLY INTEGRATED DUAL LOCKING MECHANISM WITH RESET MECHANISM

(71) Applicant: The Sun Lock Company, Ltd., Tuen Mun, N. T. (HK)

(72) Inventor: Karl Lai, Tai Po (HK)

(73) Assignee: The Sun Lock Company, Ltd., Tuen Mun, N.T. (HK)

( * ) Notice: Subject to any disclaimer, the term of this patent is extended or adjusted under 35 U.S.C. 154(b) by 551 days.

This patent is subject to a terminal disclaimer.

(21) Appl. No.: 14/929,880

(22) Filed: Nov. 2, 2015

(65) Prior Publication Data

US 2017/0009488 A1 Jan. 12, 2017

Related U.S. Application Data

(60) Provisional application No. 62/189,344, filed on Jul. 7, 2015.

(51) Int. Cl.
*E05B 37/00* (2006.01)
*E05B 67/24* (2006.01)
(Continued)

(52) U.S. Cl.
CPC ..... *E05B 67/24* (2013.01); *E05B 37/0034* (2013.01); *E05B 37/0058* (2013.01);
(Continued)

(58) Field of Classification Search
CPC ..... E05B 37/0034; E05B 37/0058; E05B 37/025; E05B 37/105; E05B 37/0048;
(Continued)

(56) References Cited

U.S. PATENT DOCUMENTS 1,001,104 A * 8/1911 Wayda ..... E05B 37/0034 70/21
1,482,515 A * 2/1924 Hainline ..... E05B 37/025 70/27

(Continued)

FOREIGN PATENT DOCUMENTS

CN 101315007 12/2008
EP 1837466 9/2007

(Continued)

OTHER PUBLICATIONS

Search Report issued by the GB Intellectual Property Office dated Mar. 15, 2016 in counterpart GB application No. GB1516376.9 (1 page).

(Continued)

*Primary Examiner* — Peter M. Cuomo
*Assistant Examiner* — Morgan J McClure
(74) *Attorney, Agent, or Firm* — Ware, Fressola, Maguire & Barber LLP

(57) ABSTRACT

A dual locking padlock having a code locking mechanism and an overriding mechanism is disclosed. The housing has a top body as its top portion, a stack of dials and a stack of clutches mounted on a middle portion and a bottom portion having holes to receive screws from the top body for securing the housing. Dials are engagingly mounted on the clutches and only rotatable relative to the clutch when the lock is in the opened mode for changing the combination code. The housing has a spindle having a channel to store the heel of a shackle. The spindle's upward movement allows the shackle to be pulled upward to unlock the padlock. The spindle is allowed to move upward either when a correct combination code is used or when a key activates the overriding mechanism. With the overriding mechanism, the padlock can also be opened with a key.

14 Claims, 13 Drawing Sheets

(51) Int. Cl.
*E05B 37/02* (2006.01)
*H01H 9/28* (2006.01)
*H01H 9/20* (2006.01)

(52) U.S. Cl.
CPC ..... *E05B 37/025* (2013.01); *H01H 9/20* (2013.01); *H01H 9/287* (2013.01)

(58) Field of Classification Search
CPC ..... E05B 37/02; E05B 37/0068; H01H 3/14; H01H 9/20; H01H 9/287; H01H 21/26; H01H 21/32; G05G 5/02; G05G 1/44
See application file for complete search history.

(56) References Cited

U.S. PATENT DOCUMENTS 1,559,570 A * 11/1925 Giba ..... E05B 37/02 70/129
1,653,254 A 12/1927 Chisholm
1,666,453 A * 4/1928 Jakopets ..... E05B 37/025 70/25
1,728,902 A 9/1929 Cohen
1,897,922 A * 2/1933 Bradshaw ..... E05B 37/10 70/21
1,924,987 A * 8/1933 Furino ..... E05B 37/025 70/26
4,354,365 A * 10/1982 Mayer ..... E05B 37/025 70/30
4,444,029 A 4/1984 Remington
4,551,997 A * 11/1985 Huang ..... E05B 67/04 70/38 A
4,733,548 A 3/1988 Ling
4,829,794 A 5/1989 Crown
5,005,384 A * 4/1991 Lo ..... E05B 37/025 70/25
5,063,761 A * 11/1991 Ling ..... E05B 37/025 70/25
5,109,684 A * 5/1992 Grandy, Sr. ..... E05B 37/025 70/25
5,119,650 A * 6/1992 Lo ..... E05B 37/025 70/25
5,715,709 A 2/1998 Lai
5,791,172 A * 8/1998 Deighton ..... E05B 19/0005 292/199
6,029,481 A 2/2000 Lai
6,101,852 A * 8/2000 Steinbach ..... E05B 67/06 70/38 A
6,176,109 B1 1/2001 Tsui
6,209,368 B1 * 4/2001 Lee ..... E05B 37/025 70/30
6,422,051 B1 * 7/2002 Kuo ..... E05B 37/02 70/312
6,474,116 B1 11/2002 Lai
6,675,614 B2 1/2004 Lai
6,729,166 B1 5/2004 Lai
6,880,371 B2 * 4/2005 Huang ..... E05B 37/025 70/28
6,883,355 B2 4/2005 Lai
6,904,776 B1 6/2005 Lin
7,117,698 B2 10/2006 Lai
7,121,123 B2 10/2006 Yu
7,140,209 B2 * 11/2006 Lai ..... E05B 35/105 70/21
7,155,944 B1 1/2007 Lin
7,225,648 B2 6/2007 Lai et al.
7,254,971 B2 * 8/2007 Ruan ..... E05B 37/025 70/21
7,337,637 B2 * 3/2008 Kan ..... E05B 37/025 70/30
7,370,498 B1 5/2008 Miao
7,467,531 B2 12/2008 Lai et al.
7,523,628 B2 * 4/2009 Yu ..... E05B 37/0034 70/21
7,562,545 B2 7/2009 Lai et al.
7,685,851 B2 3/2010 Lai
7,765,840 B2 8/2010 Lai et al.
7,805,969 B2 * 10/2010 Poppe ..... E05B 19/205 70/312
8,001,816 B2 * 8/2011 Black ..... E05B 19/20 70/394
8,225,629 B2 * 7/2012 Zuraski ..... E05B 67/003 292/DIG. 37
8,261,583 B2 9/2012 Lai et al.
8,353,184 B2 * 1/2013 Ling ..... E05B 35/105 70/21
8,511,118 B2 8/2013 Lai et al.
8,573,010 B2 * 11/2013 Burmesch ..... E05B 37/10 70/21
8,661,861 B2 3/2014 Lai
8,720,236 B2 * 5/2014 Ling ..... E05B 37/0034 70/21
8,776,556 B2 7/2014 Lai
8,881,558 B2 * 11/2014 Misner ..... E05B 35/105 70/21
8,919,155 B2 12/2014 Lai
8,931,313 B2 1/2015 Lai
8,966,946 B2 3/2015 Lai
9,206,625 B2 12/2015 Lai
9,562,369 B2 * 2/2017 Kuo ..... E05B 37/0048
2003/0150245 A1 8/2003 Lai
2004/0031298 A1 2/2004 Lai
2005/0092036 A1 5/2005 Lai
2006/0027000 A1 2/2006 Yu
2006/0027001 A1 2/2006 Lai
2006/0150690 A1 * 7/2006 Lai ..... E05B 35/105 70/21
2006/0243005 A1 11/2006 Lai et al.
2006/0260369 A1 11/2006 Lai et al.
2008/0011025 A1 1/2008 Lin
2008/0083251 A1 4/2008 Lai et al.
2008/0098774 A1 5/2008 Huang
2008/0250825 A1 10/2008 Lai
2009/0113947 A1 * 5/2009 Lai ..... E05B 35/105 70/21
2012/0304711 A1 12/2012 Misner et al.
2013/0025333 A1 1/2013 Lai
2013/0036778 A1 2/2013 Lai
2013/0118215 A1 5/2013 Lai
2014/0026626 A1 1/2014 Lai
2014/0250952 A1 9/2014 Lai
2014/0352371 A1 12/2014 Lai
2014/0366592 A1 12/2014 Bao et al.
2014/0373579 A1 12/2014 Lai
2015/0322692 A1 * 11/2015 Lai ..... E05B 37/14 70/21
2015/0330104 A1 11/2015 Lai

FOREIGN PATENT DOCUMENTS

| | | |
|---|---|---|
| EP | 2738326 | 6/2014 |
| GB | 203929 | 9/1923 |
| GB | 2493266 | 1/2013 |
| GB | 2498242 | 7/2013 |
| GB | 2519128 | 4/2015 |
| JP | 07305553 | 11/1995 |
| JP | 2011168983 | 9/2011 |
| TW | M247658 | 10/2004 |

OTHER PUBLICATIONS

Examination Report issued by the GB Intellectual Property Office dated Mar. 15, 2016 in counterpart GB application No. GB1516376.9 (4 pages).
International Search Report dated Oct. 12, 2015 in counterpart international application No. PCT/IB2015/053122 (4 pages).

* cited by examiner

PADLOCK WITH FULLY INTEGRATED DUAL LOCKING MECHANISM WITH RESET MECHANISM

CROSS REFERENCE TO RELATED PATENT APPLICATION

This application claims priority under 35 USC § 119 to U.S. Provisional Patent Application No. 62/189,344, filed Jul. 7, 2015, whose entire contents are hereby incorporated by reference.

TECHNICAL FIELD

The present invention relates to padlocks, in particular a padlock with a dual locking mechanism.

BACKGROUND OF THE INVENTION

Numerous padlock constructions have been developed and are widely employed to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing the lock. Typically, the combination lock has one mode or position in which the user is able to set or reset the desired combination sequence.

In airplane travel, new regulations and requirements allow customs officers or transit security personnel to physically break any padlock in order to gain access to luggage which is deemed suspicious. Under these new security regulations, all luggage must be scanned or inspected to prevent the transportation of potentially dangerous items or products which are deemed to be undesirable. Currently a padlock may have two separate and independent locking systems, with both locking systems independently enabling a single shackle to be released and/or lockingly engaged. In this way, by employing either a key activation zone or a combination activation zone, the padlock can be opened. The key activation zone allows security personnel to open the padlock with a master key and then re-lock the padlock in place after the inspection has been completed.

SUMMARY OF THE INVENTION

The present invention provides a dial padlock with dual locking mechanism. The padlock can be opened by a combination code or by a key-overriding mechanism.

One aspect of the present invention is a padlock operable in a locked mode and in an opened mode, comprising:

a shackle having a heel and a toe;

a lock housing configured to store the heel of the shackle, the lock housing comprising a top portion, a middle portion and a bottom portion, wherein the shackle can be partially released from the lock housing from a first shackle position to a second shackle position;

a spindle disposed inside the lock housing and arranged to provide a code locking mechanism, the code locking mechanism configured to operate the padlock in the locked mode or in the opened mode based on a combination code, the spindle comprising a cylindrical surface;

a plurality of clutches rotatably mounted on the cylindrical surface of the spindle;

a plurality of dials mounted in the middle portion of the lock housing in relationship to the clutches to form the combination code; and an overriding mechanism disposed in relationship to the spindle, the overriding mechanism activatable to cause the padlock to operate in the opened mode, wherein the shackle is in the first shackle position when the padlock is operated in the locked mode, and the shackle is in the second shackle position when the padlock is operated in the opened mode, wherein each of the clutches comprises an extended outer ring having thereon one or more extended fins, and each of the dials comprises an extended inner ring having thereon a plurality of ring gaps arranged to receive said one or more extended fins of a clutch so as to control rotational movement of said clutch relative to the spindle.

According to an embodiment of the present invention, the heel of the shackle comprises a neck area, and said padlock further comprises a latch having a fork arranged to engage the neck area of the heel so as to prevent the shackle from moving away from the first shackle position when the padlock is operated in the locked mode.

According to an embodiment of the present invention, the spindle comprises a spindle channel for storing the heel, the spindle channel having a channel portion for storing part of the neck area of the heel, and the latch is disposed in relationship to the channel portion, and wherein the spindle further comprises a cam arranged to engage the latch so as to keep the fork in an engaging relationship with the neck area of the heel.

According to an embodiment of the present invention, the overriding mechanism can be activated by a key, causing the cam to disengage the fork of the latch from the neck area of the heel, allowing the shackle to move from the first shackle position to the second shackle position.

According to an embodiment of the present invention, the bottom portion of the lock housing comprises a bottom body, and the spindle is movably mounted on the bottom body such that the spindle can be caused to move upward toward the top portion of the lock housing in a vertical movement from a first spindle position to a second spindle position, and wherein each of the clutches comprises an extended inner ring having a ring thickness and an opening gap made through the ring thickness, and the spindle comprises a plurality of extended protrusions extended from the cylindrical surface, each extended protrusion associated with a clutch such that the inner ring of the clutch prevents the spindle from moving upward when the extended protrusion is misaligned with the opening gap of the associated clutch.

According to an embodiment of the present invention, when the padlock is operated in the locked mode, the dials can be rotated relative to the spindle to change the combination code and the clutches are caused to rotate along with the dials, such that when the combination code matches a predetermined code, the opening gap of each of the clutches aligns with an associated extended protrusion of the spindle, allowing the spindle to move from the first spindle position to the second position when the shackle is pulled upward from the first shackle position to the second shackle position, causing the padlock to operate in the opened mode.

According to an embodiment of the present invention, the plurality of dials form a dial stack comprising a first dial and a last dial, the last dial positioned in contact to the bottom body of the lock housing, and the top portion of the lock housing comprises a top body mounted on the first dial, the top body comprising a locking hole and a top body hole, the locking hole dimensioned to receive the toe of the shackle, the top body hole in communication with the spindle channel for placement of the heel of the shackle, and wherein the top body hole has a first extended notch and a second extended notch, wherein the heel of the shackle comprises a shackle protrusion located inside the lock housing adjacent to the top body hole when the shackle is in the first shackle position such that when the shackle is caused to move upward to the second shackle position, the shackle protrusion is also caused to move outside of the lock housing through the first extended notch.

According to an embodiment of the present invention, the plurality of clutches form a clutch stack having a first clutch associated with the first dial and a last clutch associated with the last dial, and wherein the spindle comprises a spindle edge extended from the cylindrical surface of the spindle, the spindle edge positioned in relationship to the extended inner ring of the first clutch, so that when the shackle in the second shackle position is caused to rotate so as to align the shackle protrusion with the second extended notch of the top body hole, the heel of the shackle is allowed to move downward to cause the spindle to move downward in a downward movement, the downward movement of the spindle causing the clutches to disengage from the dials as the spindle edge of the spindle pushes the extended inner ring of the first clutch downward.

According to an embodiment of the present invention, the downward movement of the spindle also causes the extended protrusions of the spindle to engage the opening gaps of the clutches, preventing the clutches from rotation relative to the spindle, and as the clutches are disengaged from the dials, the dials can be independently and individually rotated for changing the pre-determined code in a reset process.

According to an embodiment of the present invention, the bottom portion of the lock housing comprises a spring arranged to provide an urging force to move the clutches upward after the shackle and the spindle are caused to move upward following the downward movement of the spindle.

According to an embodiment of the present invention, each of the clutches comprises a first side and an opposing second side, the first side comprising said one or more extended fins, the opposing second side having a surface having a plurality of surface indents, said padlock further comprising a plurality of ratchet-wave plates, each of the ratchet-wave plates arranged to associate with a clutch, each ratchet-wave plate comprising one or more plate edges arranged to contact different ones of the surface indents as said clutch is caused to rotate relative to the associated ratchet plate.

According to an embodiment of the present invention, the spindle further comprises an elongated slot made into part of the cylindrical surface of the spindle, and each of the ratchet-wave plates comprises a first plate ring having an inner diameter arranged to receive the cylindrical surface of the spindle, wherein each of the ratchet-wave plates further comprises a first plate slot arranged to receive one of the extended protrusions of the spindle, and a first plate tail extended from the first plate ring into the inner diameter, the first plate tail arranged to locate in the elongated slot of the spindle so as to prevent the ratchet-wave plate from rotating relative to the spindle.

According to an embodiment of the present invention, the padlock further comprises a plurality of reset-ratchet plates, each reset-ratchet plate positioned adjacent to a ratchet-wave plate, each reset-ratchet plate comprises a second plate ring having an inner diameter arranged to receive the cylindrical surface of the spindle, wherein each of the reset-ratchet plates further comprises a second plate slot arranged to receive one of the extended protrusions of the spindle, and a second plate tail extended from the second plate ring into the inner diameter of the second plate ring, the second plate tail arranged to locate in the elongated slot of the spindle so as to prevent the reset-ratchet plate from rotating relative to the spindle, and wherein each of the reset-ratchet plates comprises a plurality of fingers extended from an outer diameter of the second plate ring and each of the dials comprises an inner surface having a plurality of surface slots arranged to contact the finger of a reset-ratchet plate when said each of the dials is rotated relative to the spindle.

According to an embodiment of the present invention, the extended inner ring further comprises a plurality of faulty notches made through a part of the ring thickness.

According to an embodiment of the present invention, the bottom portion of the lock housing comprises a plurality of screw receiving holes, and the lock housing further comprises screws arranged to fasten the top body to the screw receiving holes on the bottom portion, and wherein the top body comprises screw holes configured for insertion of the screws, and the spindle comprises a plurality of screw passing slots on the cylindrical surface to allow the screws to reach the screw receiving holes on the bottom body.

BRIEF DESCRIPTION OF THE DRAWINGS

FIG. 2B is an isometric view showing part of the bottom of the sealing cap.

DETAILED DESCRIPTION OF THE INVENTION

Figure 1A:
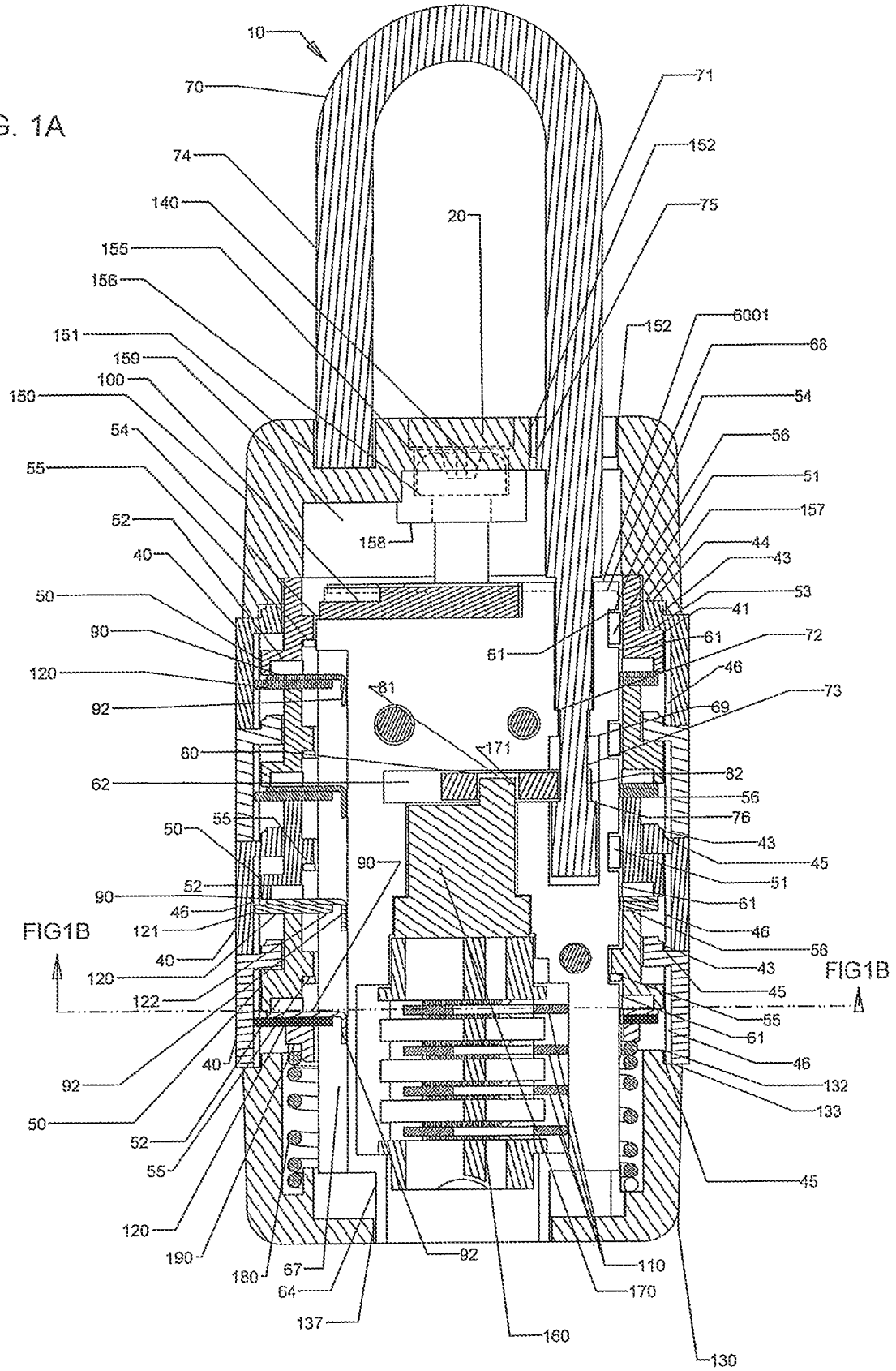
FIG. 1A shows a cross sectional side view of the padlock in a locked mode.
Figure 1B:
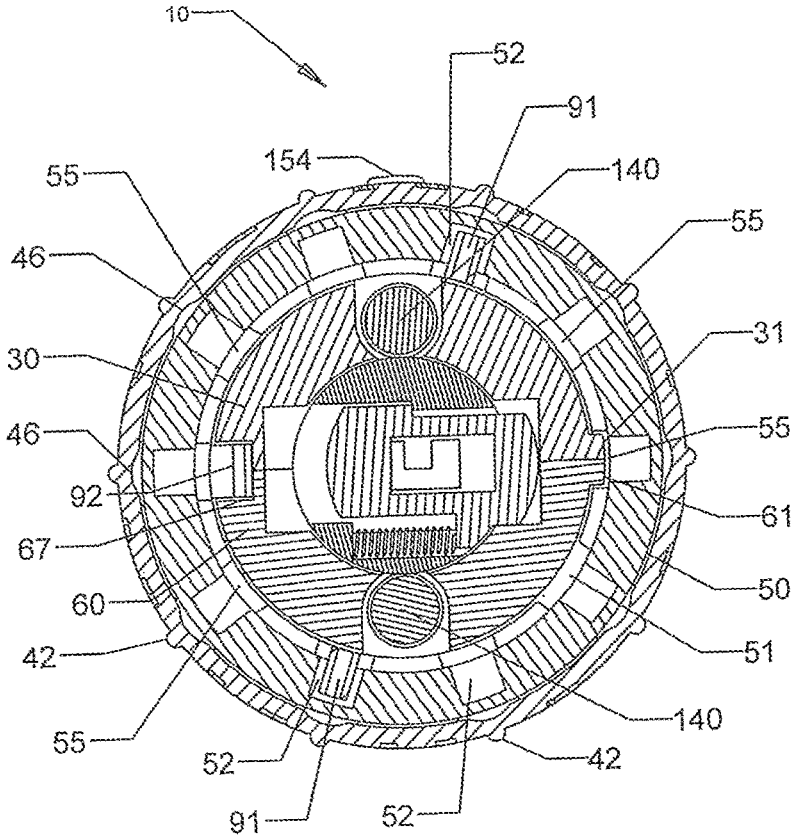
FIG. 1B shows a cross sectional bottom view of the padlock of FIG. 1A.
Figure 2A:
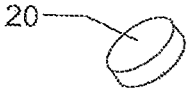
FIGS. 2A and 2B show different views of a sealing cap.
Figure 2B:
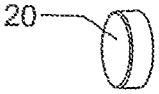
Figure 3A:
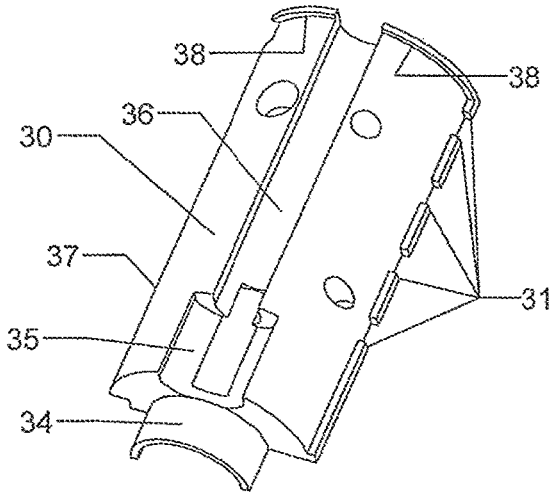
FIGS. 3A and 3B show different views of one half of the spindle.
Figure 3B:
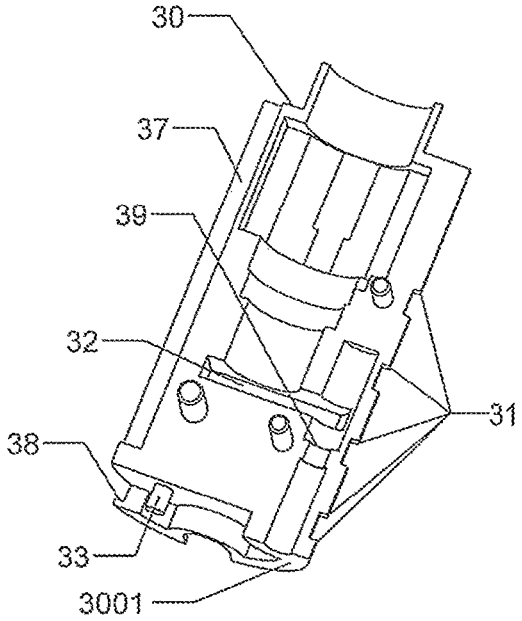
Figure 6A:
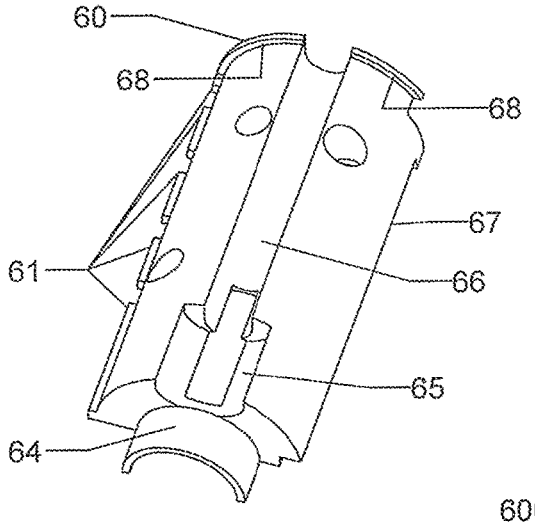
FIG. 6A and 6B show different views of another half of the spindle.
Figure 6B:
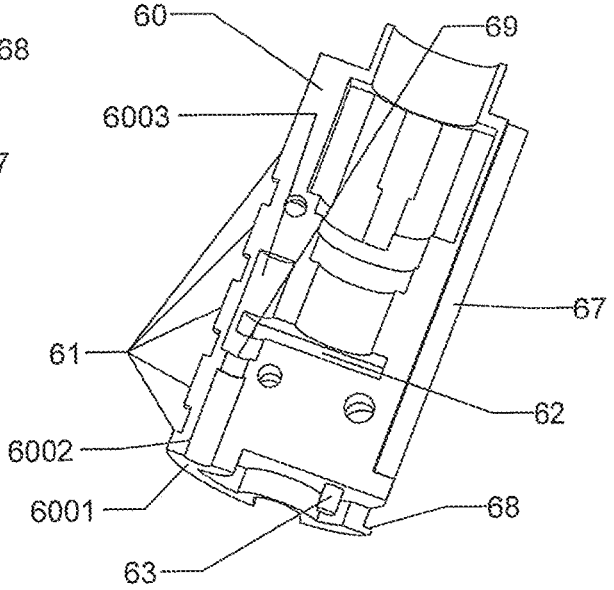
Figure 7:
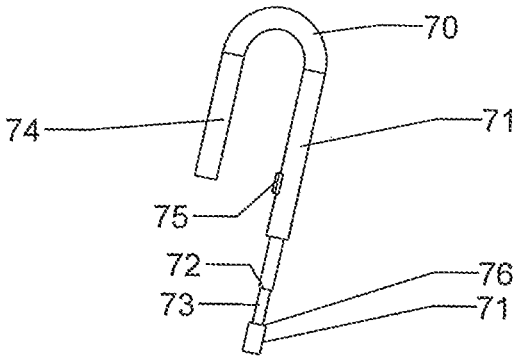
FIG. 7 is an isometric view of the spindle.
Figure 8:
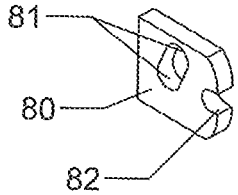
FIG. 8 is an isometric view of a latch.
Figure 9:
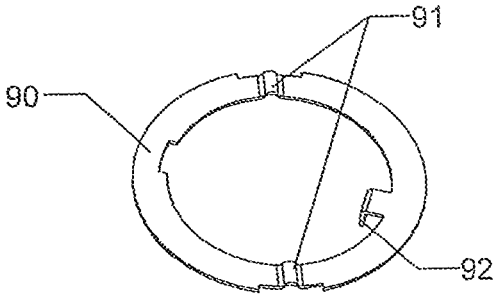
FIG. 9 is an isometric view of a ratchet-wave plate.
Figure 10:
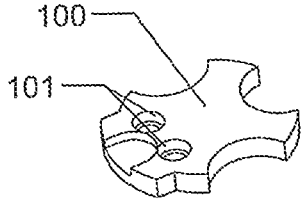
FIG. 10 is an isometric view of a top cap.
Figure 11:
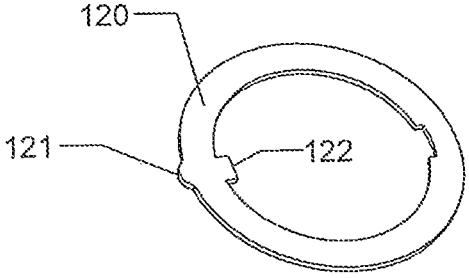
FIG. 11 is an isometric view of a reset-ratchet-plate.
Figure 12A:
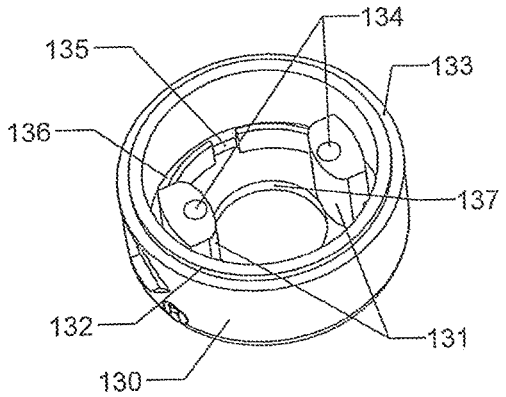
FIG. 12A is an isometric view of the top side of a bottom body.
Figure 12B:
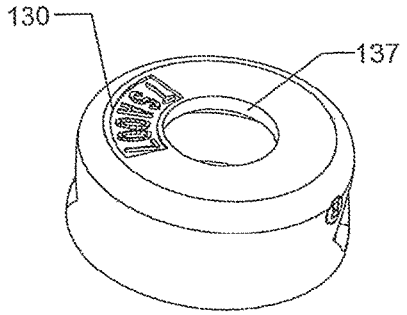
FIG. 12B is an isometric view of the bottom side of the bottom body.
Figure 13A:
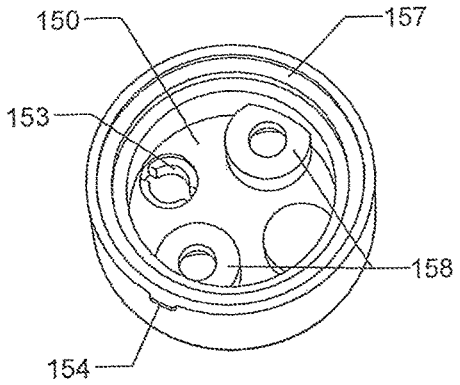
FIG. 13A is an isometric view of the bottom side of a top body.
Figure 13B:
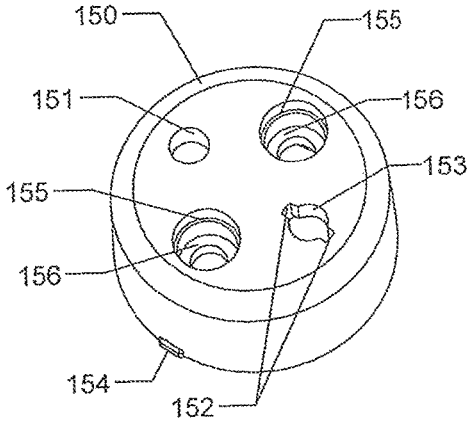
FIG. 13B is an isometric view of the top side of the top body.
Figure 14:
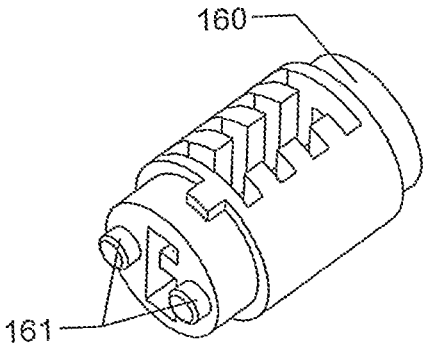
FIG. 14 is an isometric view of a cylinder.
Figure 15:
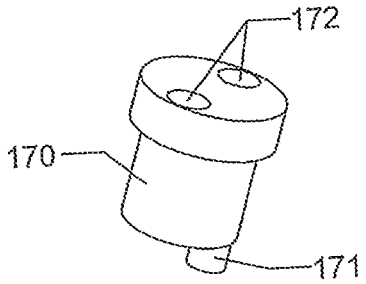
FIG. 15 is an isometric view of a cam.
Figure 16A:
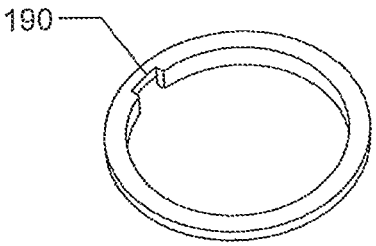
FIG. 16A is an isometric view of the top side of a reset cup.
Figure 16B:
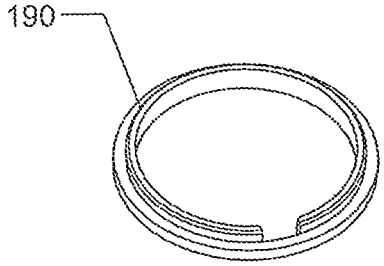
FIG. 16B is an isometric view of the bottom side of the reset cup.

As seen in FIGS. 1A, 1B and 6B, the present invention is directed to a dial padlock with dual locking mechanism, which is enclosed in a lock housing. The padlock 10 can be opened by a combination code and by a key overriding mechanism. The lock housing has three portions: an upper portion, a middle portion and a bottom portion. The top portion includes a top body 150; the middle portion includes the plurality of dials 40 and clutches 50, and the bottom portion includes a bottom body 130. The lock housing is configured to store the long leg 71 (heel) of shackle 70. The dual locking mechanism includes a spindle 60 located inside the lock housing to provide a code locking mechanism in order to keep the padlock in the locked mode based on a combination code. The combination locking system is controlled by dials 40 which are mounted on the clutches 50 to control the rotational movement of the clutches 50. When all dials 40 are turned to the preset lock-open combination, the clutches are turned accordingly such that the opening gap 51 of each clutch 50 aligns with extended protrusion 61 of the spindle 60. The opening gap is made through the thickness of an extended inner ring of clutch 50. The alignment allows the user to pull the spindle 60 upward (away from the bottom portion of the lock housing) to place the padlock 10 in an opened mode. The spindle 60 has a spindle channel 6002 to place the long-leg 71 of the shackle 70 in the lock housing and the spindle channel 6002 has a lower channel portion 6003 with a stop wall 69. The shackle 70 is placed in the following position: the long-leg 71 of the shackle 70 has a neck area 73 partially located in the lower channel portion 6003 of the spindle. The neck area 73 has an upper surface 72 and a lower surface 76. There is a latch 80 placed between the upper surface 72 and the lower surface 76 of the neck area 73 of shackle 70. In the combination-open mode and locked mode, the fork 82 of latch 80 always engages the lower surface 76 of the neck area 73 of shackle 70. The latch 80 is placed inside a latch channel 62 of spindle 60. As such, the shackle 70 and the spindle 60 are pulled up or pushed down together. In the key-open mode, the lower surface 76 of the neck area 73 of shackle 70 and the stop wall 69 in the spindle channel limit the upward movement of the shackle 70. To open the lock in the combination mode, the opening-gap 51 of clutch 50 is aligned with the extended protrusion 61 of spindle 60, and then the shackle 70 can be pulled upward.

Figure 4A:
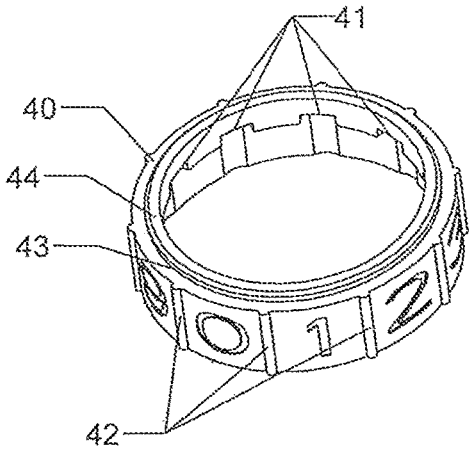
FIGS. 4A and 4B show different views of a dial.
Figure 4B:
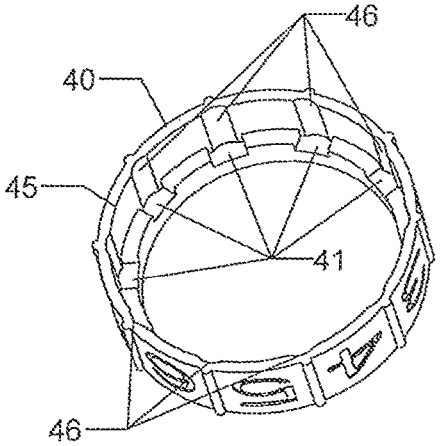
Figure 5A:
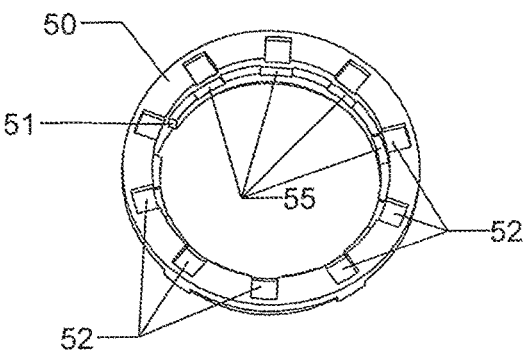
FIG. 5A and 5B show different views of a clutch.
Figure 5B:
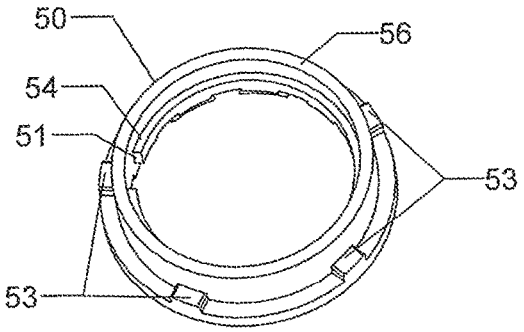

An advantage of this padlock is the reset mechanism. Once the user has opened the padlock by a combination code, the user has to rotate the shackle 180 degree (could be a different angular amount—degrees, depending on how the top-body hole 153 is configured) and then pushes the shackle 70 downward into the reset position. As the user pushes the shackle 70 downward into the reset position, the spindle 60 is also pushed downward. However, the extended-protrusion 61 of spindle 60 remains engaged in the opening-gap 51 of an associated clutch 50. As such, the clutches 50 cannot be rotated relative to the spindle 60 in the reset mode. As the edge 68 of spindle 60 contacts the inner surface 54 of the top clutch 50, a further downward movement of the spindle 60 pushes all the clutches 50 downward, causing all extended fins 53 of each clutch 50 to disengage from the ring gaps 41 of the associated dial 40. The inner surface 54 is on the upper surface of an extended inner ring of each clutch 50. The extended fins 53 are provided on an extended outer ring of the clutch 50, and the ring gaps 41 are provided on an inner ring of the dial 40. Once they are disengaged, the user can rotate the dials 40 to set a new code by aligning the desired number to the indicating mark 154 of top body 150. As described above, the rotational movement of the dials 40 will not transfer to the clutches when the extended-fins 53 disengage from the ring gaps 41 of dial 40. However, the opening-gap 51 of clutch 50 remains engaged with the extended protrusion 61 of spindle 60, and the clutches are prevented from having a rotational movement. After setting a new combination code, the user can release the shackle 70. The spring 180 at the bottom will exert an upward force to make all clutches 50 to move upward. The extended-fin 53 of each clutch 50 will engage the ring gaps 41 of a dials 40. As shown in FIGS. 4A and 4B, each of the dials 40 has an extended inner ring extended inward from the inner diameter of the dials 40 to form the ring gaps 41 on the lower part of the extended inner ring and a step 44 on the upper part of the extended inner ring. The step 44 has an outer diameter smaller than the inner diameter of the dial 40. Each of the dials 40 also has a number of surface slots 46 made into the inner diameter of the dials 40.

The spring 180 is placed on the bottom body 130 inside the lock housing and a reset cup 190 is placed on top of the spring 180 to transfer the upward urging force of the spring 180 to the stack of clutches 50 above until the extended-fin 53 of each clutch 50 contacts the ring gap 41 of an associated dial 40, making the clutch 50 and the dial 40 to be in the engaged position. As can be seen FIG. 1A, beneath each of the clutches 50, there is a ratchet wave-plate 90 on top of a reset ratchet-plate 120. The ratchet wave-plate 90 comprises one or more wave edges 91 which contact the ratchet gate 52 of clutch 50. The ratchet wave-plate 90 also comprises a tail 92 which is placed inside of the tail-receiving slot 67 of spindle 60 to prevent the ratchet wave-plate 90 from having a rotational movement relative to the spindle 60, which has no rotational movement in all the modes. When the lock is in the locked position, each of the clutches turns with the associated dial 40. As the user turns each of the dials 40, some of the ratchet gates 52 of the clutch 50 engage the wave-edges 91 of ratchet wave-plate 90. This makes each turning of the dial 40 to have a "clicking" sound and feeling. Furthermore, each of the reset ratchet plates has a finger 121 arranged to engage the surface slots 46 of a dial 40. As the user turns the dials 40 in the reset mode, the finger 121 will be in contact to the surface slots 46 of the dial 40, which provides the ratchet feeling during in the reset mode.

Figure 20:
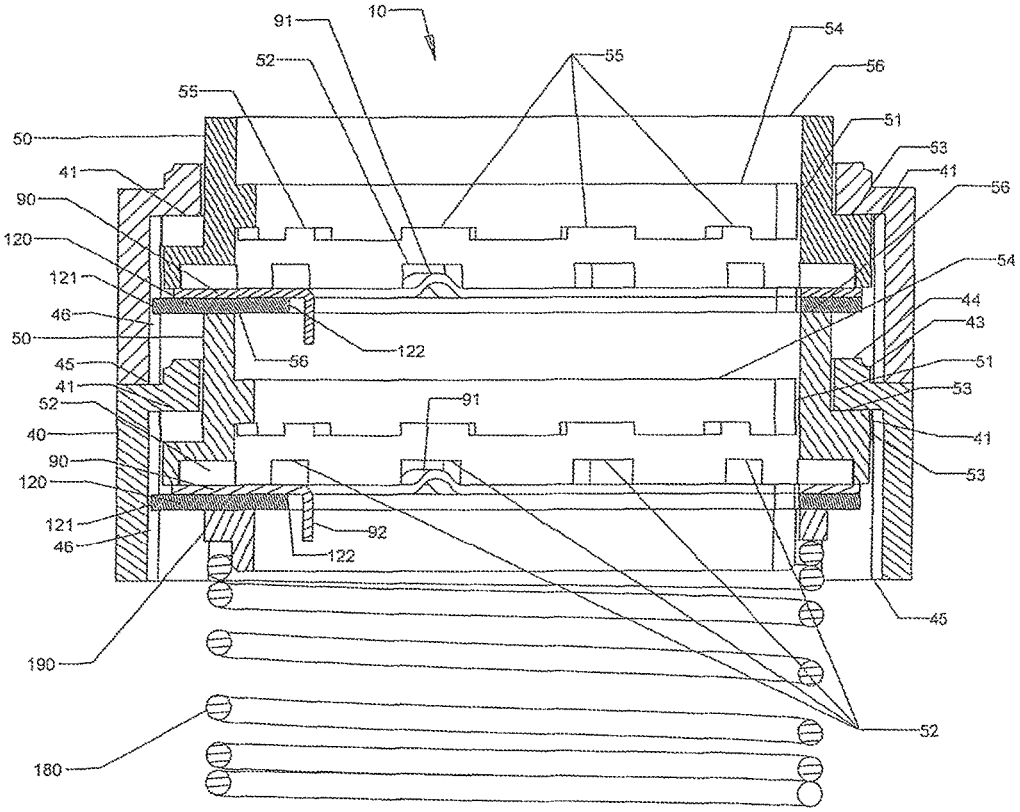
FIG. 20 is a cross sectional side view of part of the padlock, showing the relationship between the dials, the clutches, the ratchet-wave plates, the reset-ratchet plates, the reset cup and the spring.

Another feature of this lock is the anti-peek function, since one dial stacks up with another dial, the dial 40 below has a step surface 44 which is placed at the bottom end 45 of the dial 40 above (FIG. 20). Furthermore, the top body 150 has a step-edge surface 157 which will connect to the step surface 44 of the top dial 40, and the bottom body 130 has a step 132 which will connect to the bottom end 45 of the bottom dial 40. With such steps and their placement, the step surface 44 of dial 40 and the step 132 of bottom body 139 would block the view of the internal mechanism of the lock, making picking the lock difficult. In addition, the lock 10 has screws 140 for fastening the top body 150 to the bottom body 130 through the screw holes 156 of top body 150, the dials 40, the clutches 50 and the spindle 60 to reach the screw holes 134 of bottom body 130. A sealing cap 20 is then placed inside of the screw-cap hole 155 to conceal each of the screws 140. In the lock housing, the dials are stacked up one on top another such that while the dials can be rotated, they have no vertical (upward and downward) movement.

Finally, another advantage of this padlock is to allow the traveler to use the combination mechanism during their trip and allow the TSA officer to inspect luggage by using the key operate mechanism.

Placement of Dial, Clutch, Ratchet-Wave Plate, Reset-Ratchet Plate and Spindle (FIG. 1A-1B and FIG. 20):

The spindle 60 has a tail-receiving slot 67 to receive the tail 92 of ratchet-wave plate 90 and the tail 122 of reset-ratchet plate 120. A ratchet-wave plate 90 is placed underneath each clutch 50 with the tail 92 placed in the tail-receiving slot 67 of the spindle 60. This prevents the ratchet-wave plate 90 from having a rotational movement. The clutch 50 has ratchet gates 52 to receive the wave edge 91 of a ratchet-wave plate 90 so that every rotational movement of the clutch 50 will have ratchet (clicking) feelings due to the wave edge 91 that engages each ratchet gate 52 of clutch 50. Underneath each ratchet-wave plate 90, there is a reset-ratchet plate 120. Each reset-ratchet plate 120 has a finger 121 to engage the surface slots 46 of a dial 40. The stacking of the clutches 50, the ratchet-wave plates and the reset-ratchet plate 120 is carried out such that the top edge 56 of the clutch 50 below will contact the reset-ratchet plate 120 above. Each clutch 50 is placed inside of a dial 40 such that the ring gaps 41 of the dial 40 will engage the extended fin 53 of clutch 50 in the locked mode, combination-open mode, and in the key-open mode. The ring gaps 41 of dial 40 will disengage from the extended fin 53 of clutch 50 only in the reset mode. The dial 40 further comprises a plurality of digit separation s 42 to separate the digits.

Locked Mode and Lock Configuration (FIG. 1A-16B and FIG. 20):

The spindle 30/60 has two parts riveted together to become a single piece, which is referred to hereafter as a spindle 60. The spindle 60 has two pins 33 and 63 arranged to receive the cap holes 101 of a top cap 100 as the spindle halves are riveted to become spindle 60. The spindle 60 has a spindle channel 6002 with a lower channel portion 6003 arranged to store the neck area 73 of the shackle 70. The spindle 60 also has a latch channel 62 for placement of a latch 80. It is understood that the spindle 60 is riveted into one piece after the placement of the neck area 73 of shackle 70 in the spindle channel 6002 and the placement of the latch 80 in the latch channel 62. The spindle 60 also has a curve 65 to be placed in the curve block 131 of bottom body 130. As the curve 65 of spindle 60 is in contact to the curve block 131 of bottom body 130 in all the modes, the spindle 60 has no rotational movement relative of the lock housing. The spindle 60 can only have vertical movement relative to the bottom body 130 and the entire lock housing. The screws passing slots 36, 66 of the spindle 60 will allow screws or any riveted material to pass through, without interfering with the vertical movement of the spindle 60.

The dial 40 has ring gaps 41 arranged to receive the extended fin 53 of a clutch 50. In the locked mode, the rotational movement of the dial 40 will transfer directly to the clutch 50 since the ring gaps 41 of dial 40 engage the extended fin 53 of clutch 50. Thus, the clutches 50 and the dials 40 are turned together. The dials 40 form a stack sandwiched between the top body 150 and the bottom body 130. More specifically, the bottom end of the last dial 40 contacts the step 132 of bottom body 130 and the step surface 44 of the extended ring 43 of the top dial 40 contacts the step-edge surface 157 of top body 150. As such, the dials 40 have no vertical movement. Inside the stack of dials 40, the clutches 50, the ratchet-wave plates 90, the reset-ratchet plates 120 and the reset cup 190 are mounted over the cylindrical surface of the spindle 60.

The top body 150 also has a cutout zone 159 with a surface 158 which allows the spindle 60 to move upward when the opening gaps 51 of all the clutches 50 align with the extended protrusions 61 of spindle 60. This is possible only when the dials are turned such that the combination code matches a pre-determined code—the combination open code. When the alignment is achieved, the user can pull the shackle 70 upward. As the latch 80 is engaged with the neck area 73 of shackle 70, the spindle 60 is also pulled upward until the top surface 6001 of spindle 60 contacts the surface 158 of top body 150. The short leg 74 (toe) of shackle 70 is now disengaged from the locking hole 151 of top body 150. Since the lock housing is held together by screws 140 which fasten the top body 150 to the bottom body 134, all the components of the padlock 10 will stay as one unit.

In the locked mode, when at least one of the clutches 50 is not aligned in the lock opened position, the opening gap 51 of that clutch 50 is not aligned with the extended protrusion 61 of spindle 60 preventing the spindle 60 from being pulled by the shackle 70. Since the spindle 60 is not moving upward, the short-leg 74 of shackle 70 is still locked in the locking hole 151 of top body 150.

The shackle in the sandwiched locked position is described as follow: The inside of spindle 60 placed the long leg 71 of shackle 70, the latch 80, the cylinder 160 and the cam 170. As no key is placed inside of the cylinder 160, the wafers 110 are in a locked position and the cylinder 160 cannot be turned. As the cylinder 160 cannot be turned, the cam 170 cannot be turned. The extended pin 171 of cam 170 is engaged with the slot 81 of latch 80. As the cam 170 is not able to rotate, the latch 80 is also in a locked position. The fork 82 of latch 80 engages to the bottom surface 76 of the neck area 73 of shackle 70 preventing the shackle 70 from moving upward to release the short leg 74 from the locking hole 151 of top body 150. This means that the shackle is in a sandwiched locked position.

As described above with respect to the shackle 70, latch 80, spindle 60 and the clutch 50 relationship, the spindle 60 will move upward only when the opening gap 51 of each clutch 50 aligns with the extended protrusion 61 of spindle 60.

The clutch 50 has at least one faulty notch 55 which allows the protrusion 61 of spindle 60 to contact such that the lock is harder to pick. The faulty notches 55 are provided on the lower part of the extended inner ring of each clutch 50.

Each of the dials 40 further comprises an extended ring 43 which prevents people from peeking the internal mechanism. The bottom body 130 also has a step 132 to prevent an intruder from peeking the internal mechanism of the bottom dial 40.

Figure 18B:
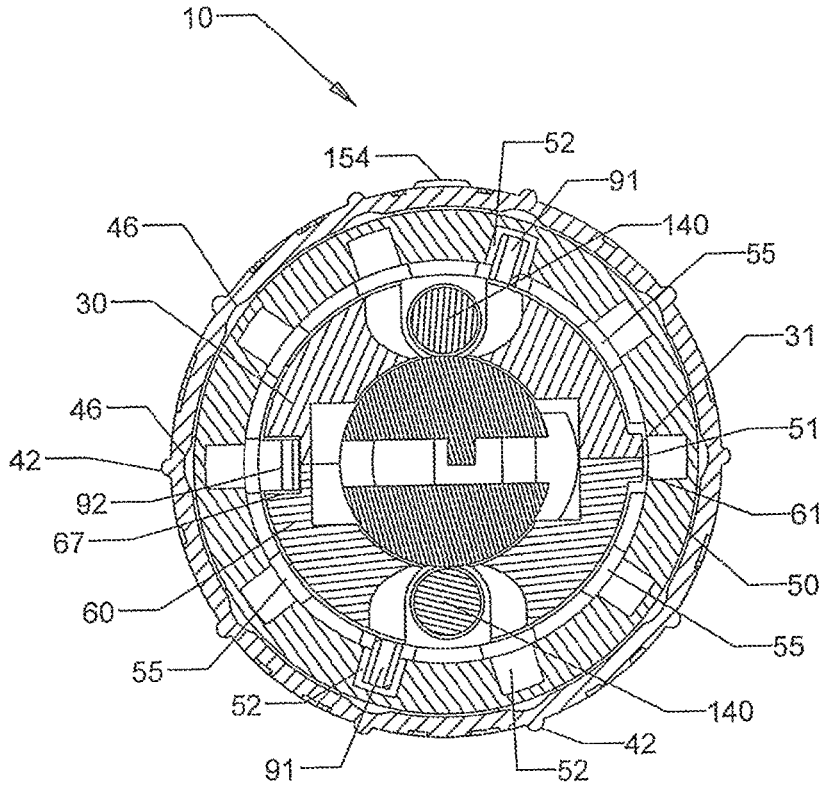
FIG. 18B shows a cross section bottom view of the padlock of FIG. 18A.
Figures 18A, 18B:
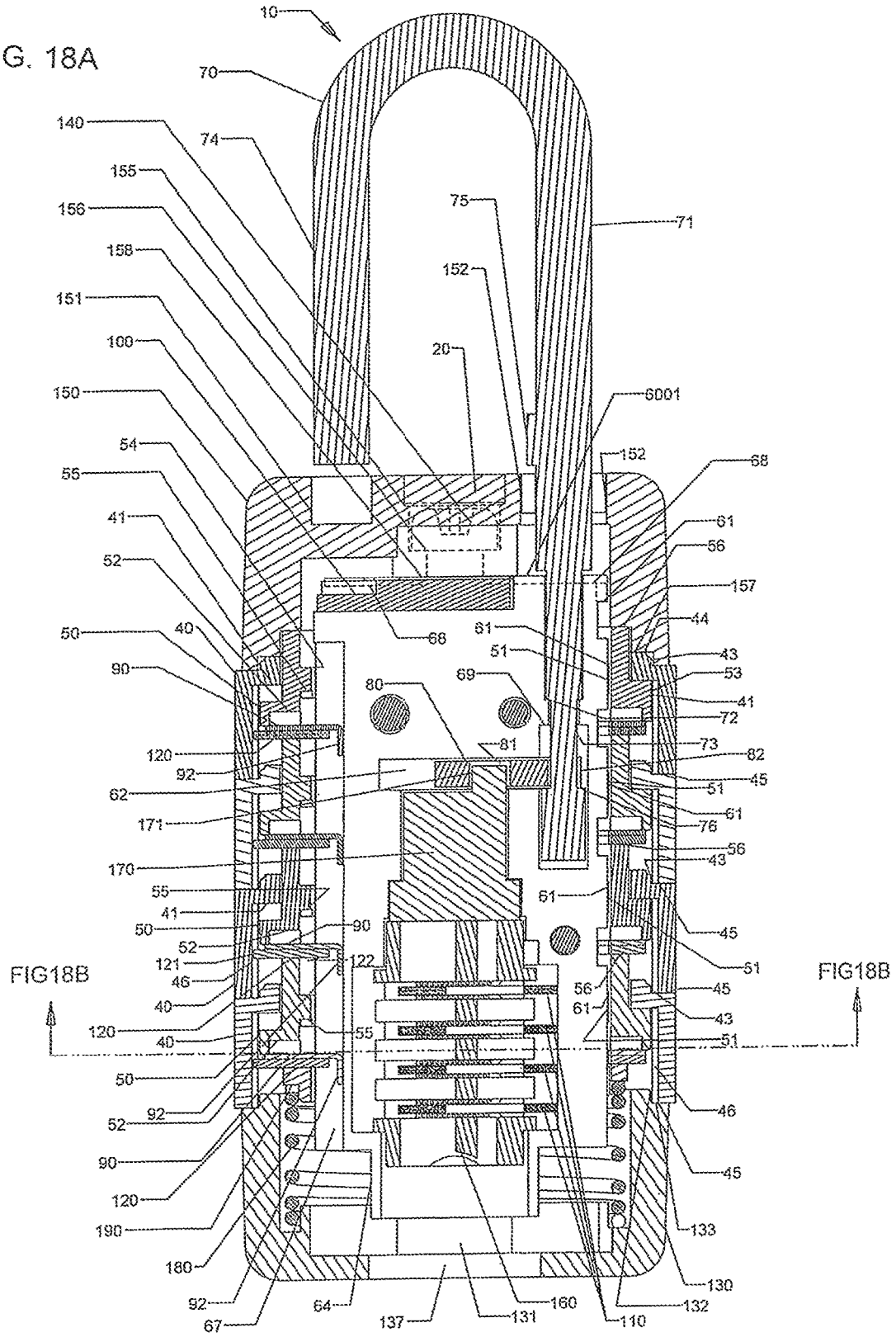
FIG. 18A shows a cross sectional side view of the padlock opened by a matching combination code.

Unlock by Combination Code (FIG. 18A-18B):

To unlock by the combination code, the user must open the padlock by aligning the dials 40 to the indicating mark 154 on top body 150. As the dials 40 align to the lock open code, the opening gap 51 of the clutches 50 will align with the extended protrusion 61 of spindle 60. When the alignment is achieved, the user can pull the shackle 70 upward which allows the spindle 60 to be pulled upward (since the shackle 70, latch 80, and spindle 60 are in the sandwiched locked position). As the shackle 70 is pulled upward, the short leg 74 of shackle 70 moves away from the locking hole 151 of top body 150. The top body 150 has a top-body hole 153 in communication with the spindle channel 6002 so as to allow the placement of the long leg 71 of shackle 70. As the shackle 70 is pulled upward, the extended protrusion 75 of shackle 70 will move out from the extended notch 152 on the top-body hole 153 of top body 150. As the shackle 70 is pulled upward, the spindle 60 will be pulled in the same manner. The spindle 60 will move upward until the top surface 6001 of spindle 60 contacts the surface 158 of top body 150. The short leg 74 of the shackle 70 will then move out of the locking hole 151 of top body 150. As the shackle is released from the locked position, it can freely rotate.

It should be noted that the spindle 60 will not have rotational movement because the big curve 65 is still engaged to the curve block 131 of bottom body 130. Since the spindle 60 has no rotational movement, the clutches 50 in the combination open mode will not have rotational movement because the extended protrusion 61 of spindle 60 engages the opening gap 51 of clutch 50. The dials 40 cannot be turned in the combination lock-open mode due to the ring gaps 41 of dial 40 engaged with the extended fin 53 of clutch 50. This helps to prevent a user from turning the dials accidentally in the combination lock-open mode such that the short leg 74 of the shackle 70 can always be able to return to the locking hole 151 of top body 150 by the user and the user is allowed to push back the short leg 74 of shackle 70 to the lock position without any problem.

The tail 122 of reset-ratchet plate 120 and the tail 92 of ratchet-wave plate 90 are placed inside of the tail-receiving slot 67 of spindle 60. This means that any rotational movement produced from dials 40 and clutches 50 will not rotate the reset-ratchet plate 120 and the ratchet-wave plate 90. This is important as these two plates 120 and 90 should not be able to rotate in all modes: locked, opened by combination, opened by key, and reset mode.

Figure 19A:
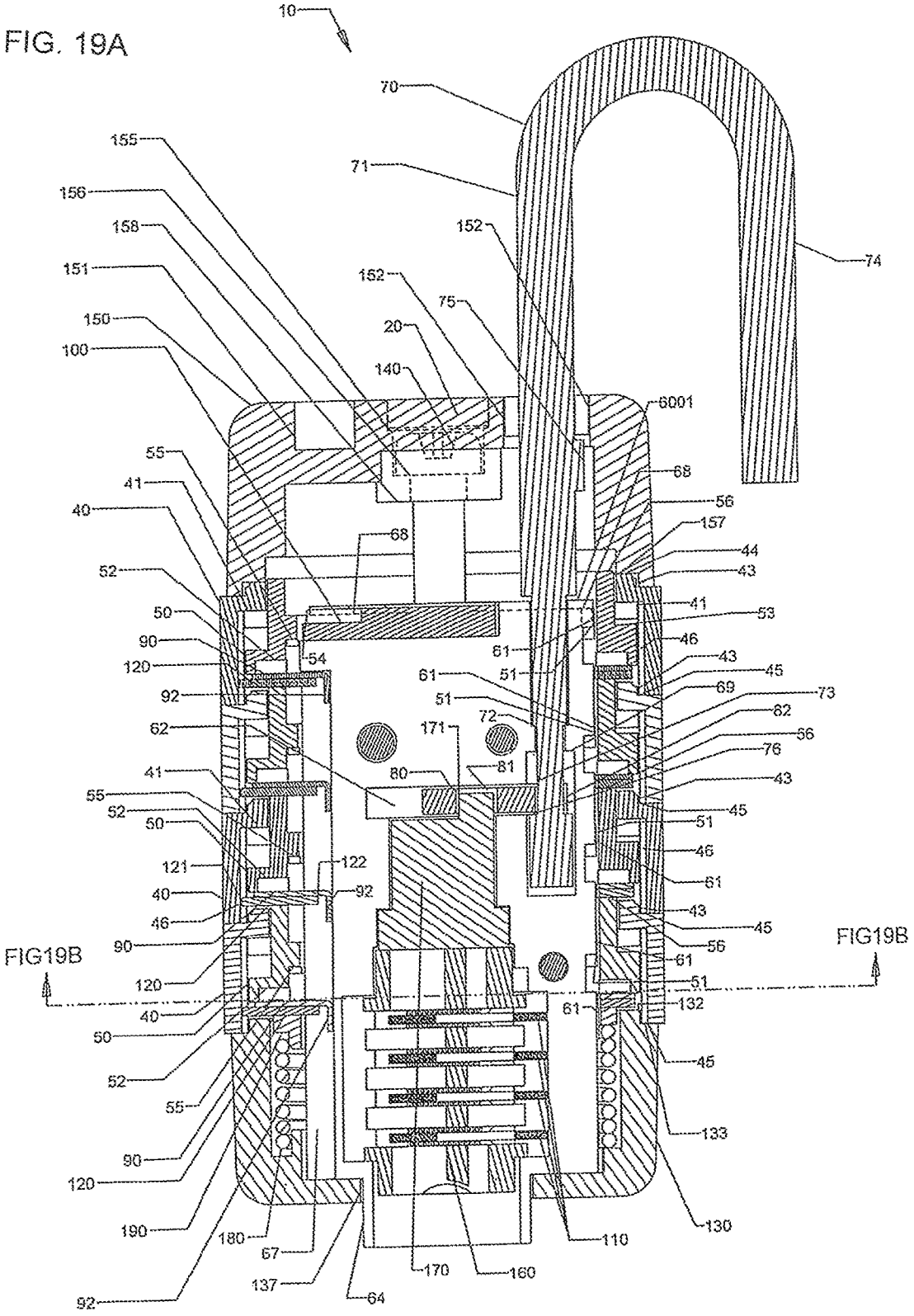
FIG. 19A shows a cross sectional side view of the padlock of FIG. 18A after the spindle is rotated away.
Figure 19B:
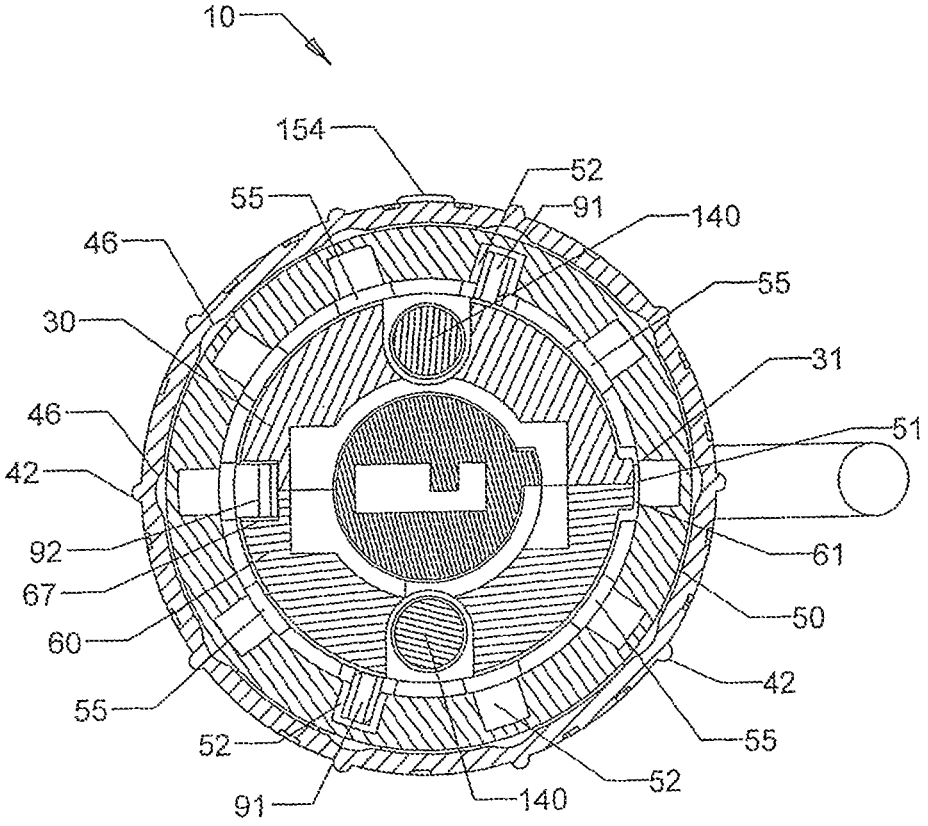
FIG. 19B shows a cross sectional bottom view of the padlock of FIG. 19A.

Reset Mode (FIG. 19A-19B):

As the user opens the lock by the combination code, the extended protrusion 61 of spindle 60 engages the opening-gap 51 of clutch 50. The user can then rotate the shackle to 180 (could be in any designated angular amount—degree), such that the extended protrusion 75 of shackle 70 can fall to the other side of the extended notch 152 of top body 150. The user can now push the shackle 70 downward again. This time, the shackle 70 will push the spindle 60 in the same manner such that, the edge 68 of spindle 60 will contact the inner surface 54 of clutch 50. As they are in contact, there is some portion of the extended protrusion 61 of spindle 60 that engages the opening-gap 51 of clutch 50, which prevents the clutch from having a rotational movement. And, as the user further pushes the shackle 70 and spindle 60 further downward, the edge 68 of spindle 60 will further push the inner surface 54 of clutch 50 further downward in the same manner, this will cause the extended fin 53 of clutch 50 to disengage from the ring gaps 41 of dial 40. As they are disengaged, the user can turn the dial 40 without rotating the clutch 50. As such, the user can set a new code. It should be noted that the opening gap 51 of clutch 50 is now engaged with the extended protrusion 61 of spindle 60. The turning of the dials 40 to line up with the indicating mark 154 of top body 150 will allow the user to adjust the code into a new desired combination.

Since the extended protrusion 61 of spindle 60 engages the opening-gap 51 of clutch 50, the clutch 50 is prevented from having any rotational movement. As the clutch 50 has no rotational movement, the ratchet-wave plate 90 will remain silent, and the ratchet feeling "clicking" will be produced by the reset-ratchet plate 120. The reset-ratchet plate 120 will not be rotated due to the tail 122 that is placed in the tail-receiving slot 67 of spindle 60. Since no rotational movement is made by the spindle 60, the reset-ratchet plate 120 will also have no rotational movement. As the user turns the dials 40 in the reset mode, the finger 121 of reset-ratchet plate 120 will be in contact to the surface slots 46 of dial 40, which will provide the ratchet feeling during in the reset mode.

The placement of the dial, the clutch, the ratchet-wave plate, and the reset-ratchet plate has been previously described. Accordingly, as the user pushes the clutch 50 downward, the set of clutches 50, ratchet-wave plate 90, and reset-ratchet plate 120 will move downward. A reset-cup 190 is placed underneath the last reset-ratchet plate 120 to separate the spring 180 and the last reset-ratchet plate 120.

After setting, the spring 180 is allowed to exert a force to push the reset-cup 190 and the set of clutches 50, ratchet-wave plates 90, reset-ratchet plates 120 to move upward until the extended fin 53 of clutch 50 engages the ring gaps 41 of dial 40. As the clutch 50, the ratchet-wave plate 90, and the reset-ratchet plate 120 are stacked together, the force from the spring 180 will pass to all of these components from the bottom clutch 50 to the upper clutch 50.

The spindle 60 has a bottom 64 which will pass through a cut-out hole 137 of bottom body 130. As in the reset mode, the bottom 64 of spindle 60 will extend outside of the cut-out hole 137 of bottom body 130, indicating the lock is in the reset mode.

Figure 17A:
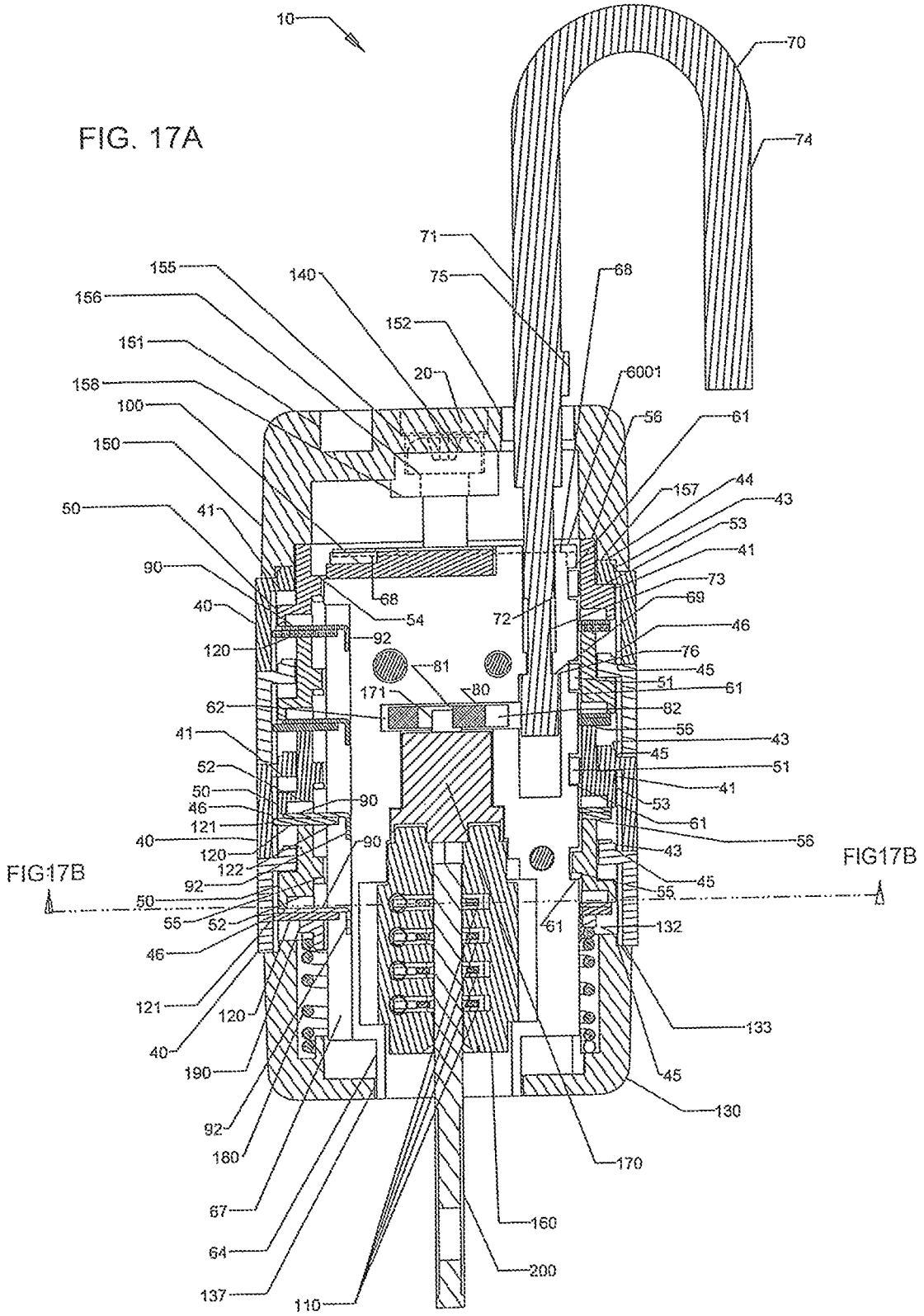
FIG. 17A shows a cross sectional side view of the padlock opened by a key with the spindle rotated away.
Figure 17B:
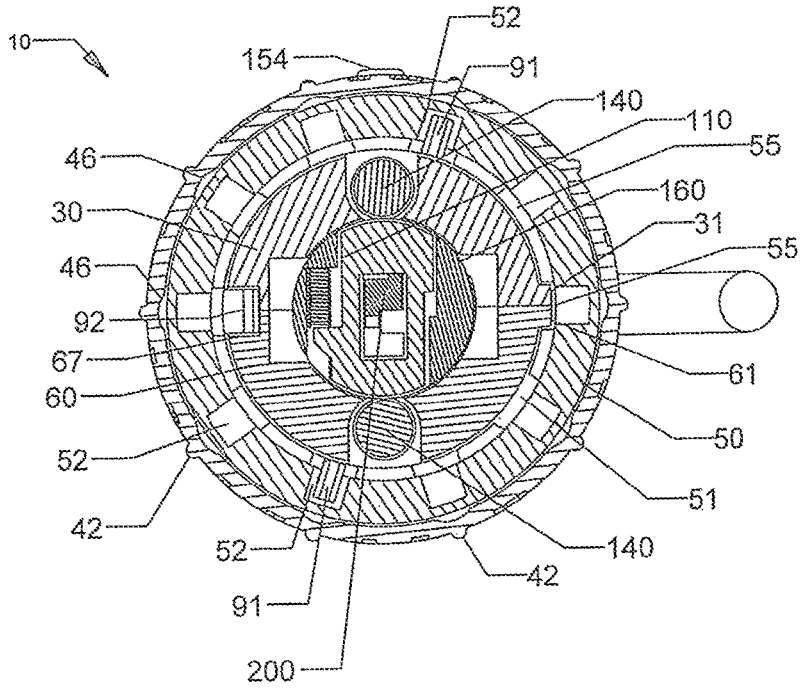
FIG. 17B shows a cross sectional bottom view of the padlock of FIG. 17A.

Unlock by Key Mechanism Mode (FIG. 17A-17B):

The key locking mechanism is controlled by a wafer-tumbler cylinder 160. The cylinder 160 has an extended pin 161 arranged to engage a hole 172 of cam 170. The cam 170 has an extended pin 171 arranged to engage the slot 81 of latch 80. The latch 80 is placed inside the latch channel 62 of spindle 60. As a correct key 200 enters, the cylinder 160 and the cam 170 can be caused to turn. As the cam 170 turns, the extended pin 171 of cam 170 drags the latch 80 sideward in horizontal movement. As such, the fork 82 of latch 80 will no longer contact the lower surface 76 of the neck area 73 of the shackle 70, and there is no blockage on the neck area 73 of shackle 70. Thus, the shackle 70 can move upward freely and can be pulled upward until the lower surface 76 of neck area 73 hits the stop wall 69 of spindle 60. The short leg 74 of shackle 70 will move upward and be released from the locking hole 151 of top body 150.

It should be noted that spindle 60 has no vertical movement when the opening gap 51 of at least one of the clutches 50 is not aligned with the extended protrusion 61 of spindle 60.

The present invention provides a dual locking padlock wherein the lock body, the cylinder, the clutches, the dials and the spindle are concentric to a center line. The shackle is placed inside of the clutches and the dials.

Although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A padlock operable in a locked mode and in an opened mode, comprising:

a shackle having a heel and a toe;

a lock housing configured to store the heel of the shackle, the lock housing comprising a top portion, a middle portion and a bottom portion, the top portion arranged to engage with the toe, wherein the shackle can be partially released from the lock housing from a first shackle position to a second shackle position;

a spindle disposed inside the lock housing and arranged to provide a code locking mechanism, the code locking mechanism configured to operate the padlock in the locked mode or in the opened mode based on a combination code, the spindle comprising a cylindrical surface;

a plurality of clutches rotatably mounted on the cylindrical surface of the spindle;

a plurality of dials mounted in the middle portion of the lock housing in relationship to the clutches to form the combination code; and an overriding mechanism disposed in relationship to the spindle, the overriding mechanism activatable to cause the padlock to operate in the opened mode, wherein the shackle is in the first shackle position when the padlock is operated in the locked mode, and the shackle is in the second shackle position when the padlock is operated in the opened mode, wherein each of the clutches comprises an extended outer ring, the extended outer ring having a ring surface facing the top portion of the lock housing, the ring surface having thereon one or more extended fins, and each of the dials has an inner wall defining an inner diameter, each of the dials comprising an extended inner ring extended inward from the inner diameter, the extended inner ring having an upper part and a lower part, the upper part having an upper surface facing the top portion of the housing, the lower part having thereon a plurality of ring gaps arranged to receive said one or more extended fins of a clutch so as to control rotational movement of said clutch relative to the spindle, wherein the bottom portion of the lock housing comprises a bottom body, and wherein the spindle is movably mounted on the bottom body such that the spindle can be caused to move upward toward the top portion of the lock housing in a vertical movement from a first spindle position to a second spindle position, and wherein each of the clutches comprises an extended inner ring having a ring thickness and an opening gap made through the ring thickness, and the spindle comprises a plurality of extended protrusions extended from the cylindrical surface, each extended protrusion associated with a clutch such that the inner ring of the clutch prevents the spindle from moving upward when the extended protrusion is misaligned with the opening gap of the associated clutch.

2. The padlock according to claim 1, wherein the heel of the shackle comprises a neck area, and said padlock further comprises a latch having a fork arranged to engage the neck area of the heel so as to prevent the shackle from moving away from the first shackle position when the padlock is operated in the locked mode.

3. The padlock according to claim 2, wherein the spindle comprises a spindle channel for storing the heel, the spindle channel having a channel portion for storing part of the neck area of the heel, and the latch is disposed in relationship to the channel portion, and wherein the spindle further comprises a cam arranged to engage the latch so as to keep the fork in an engaging relationship with the neck area of the heel.

4. The padlock according to claim 3, wherein the overriding mechanism can be activated by a key, causing the cam to disengage the fork of the latch from the neck area of the heel, allowing the shackle to move from the first shackle position to the second shackle position.

5. The padlock according to claim 1, wherein when the padlock is operated in the locked mode, the dials can be rotated relative to the spindle to change the combination code and the clutches are caused to rotate along with the dials, such that when the combination code matches a predetermined code, the opening gap of each of the clutches aligns with an associated extended protrusion of the spindle, allowing the spindle to move from the first spindle position to the second position when the shackle is pulled upward from the first shackle position to the second shackle position, causing the padlock to operate in the opened mode.

6. The padlock according to claim 5, wherein the plurality of dials form a dial stack comprising a first dial and a last dial, the last dial positioned in contact to the bottom body of the lock housing, and wherein the top portion of the lock housing comprises a top body mounted on the first dial, the top body comprising a locking hole and a top body hole, the locking hole dimensioned to receive the toe of the shackle, the top body hole in communication with the spindle channel for placement of the heel of the shackle, and wherein the top body hole has a first extended notch and a second extended notch, wherein the heel of the shackle comprises a shackle protrusion located inside the lock housing adjacent to the top body hole when the shackle is in the first shackle position such that when the shackle is caused to move upward to the second shackle position, the shackle protrusion is also caused to move outside of the lock housing through the first extended notch.

7. The padlock according to claim 6, wherein the plurality of clutches form a clutch stack having a first clutch associated with the first dial and a last clutch associated with the last dial, and wherein the spindle comprises a spindle edge extended from the cylindrical surface of the spindle, the spindle edge positioned in relationship to the extended inner ring of the first clutch, and wherein when the shackle in the second shackle position is caused to rotate so as to align the shackle protrusion with the second extended notch of the top body hole, the heel of the shackle is allowed to move downward to cause the spindle to move downward in a downward movement, the downward movement of the spindle causing the clutches to disengage from the dials as the spindle edge of the spindle pushes the extended inner ring of the first clutch downward.

8. The padlock according to claim 7, wherein the downward movement of the spindle also causes the extended protrusions of the spindle to engage the opening gaps of the clutches, preventing the clutches from rotation relative to the spindle, and as the clutches are disengaged from the dials, the dials can be independently and individually rotated for changing the pre-determined code in a reset process.

9. The padlock according to claim 7, wherein the bottom portion of the lock housing comprises a spring arranged to provide an urging force to move the clutches upward after the shackle and the spindle are caused to move upward following the downward movement of the spindle.

10. The padlock according to claim 1, wherein each of the clutches comprises a first side and an opposing second side, the first side comprising said one or more extended fins, the opposing second side having a surface having a plurality of surface indents, said padlock further comprising a plurality of ratchet-wave plates, each of the ratchet-wave plates arranged to associate with a clutch, each ratchet-wave plate comprising one or more plate edges arranged to contact different ones of the surface indents as said clutch is caused to rotate relative to the associated ratchet plate.

11. The padlock according to claim 10, wherein the spindle further comprises an elongated slot made into part of the cylindrical surface of the spindle, and wherein each of the ratchet-wave plates comprises a first plate ring having an inner diameter arranged to receive the cylindrical surface of the spindle, wherein each of the ratchet-wave plates further comprises a first plate slot arranged to receive one of the extended protrusions of the spindle, and a first plate tail extended from the first plate ring into the inner diameter, the first plate tail arranged to locate in the elongated slot of the spindle so as to prevent the ratchet-wave plate from rotating relative to the spindle.

12. The padlock according to claim 11, further comprising a plurality of reset-ratchet plates, each reset-ratchet plate positioned adjacent to a ratchet-wave plate, each reset-ratchet plate comprises a second plate ring having an inner diameter arranged to receive the cylindrical surface of the spindle, wherein each of the reset-ratchet plates further comprises a second plate slot arranged to receive one of the extended protrusions of the spindle, and a second plate tail extended from the second plate ring into the inner diameter of the second plate ring, the second plate tail arranged to locate in the elongated slot of the spindle so as to prevent the reset-ratchet plate from rotating relative to the spindle, and wherein each of the reset-ratchet plates comprises a plurality of fingers extended from an outer diameter of the second plate ring and each of the dials comprises an inner surface having a plurality of surface slots arranged to contact the finger of a reset-ratchet plate when said each of the dials is rotated relative to the spindle.

13. The padlock according to claim 1, wherein the extended inner ring of the clutch further comprises a plurality of faulty notches made through a part of the ring thickness.

14. The padlock according to claim 6, wherein the bottom portion of the lock housing comprises a plurality of screw receiving holes, and the lock housing further comprises screws arranged to fasten the top body to the screw receiving holes on the bottom portion, and wherein the top body comprises screw holes configured for insertion of the screws, and the spindle comprises a plurality of screw passing slots on the cylindrical surface to allow the screws to reach the screw receiving holes on the bottom body.

* * * * *